United States Patent [19]

Maass

[11] 4,027,991

[45] June 7, 1977

[54] CONCRETE FINISHER WITH RETRACTABLE GUARD RING SECTION

[75] Inventor: Helmut A. Maass, West Bend, Wis.

[73] Assignee: M-B-W, Inc., Slinger, Wis.

[22] Filed: Sept. 8, 1976

[21] Appl. No.: 721,266

[52] U.S. Cl. ..... 404/112

[51] Int. Cl.[2] ..... E01C 19/22

[58] Field of Search ..... 404/112, 118, 83

[56] References Cited

UNITED STATES PATENTS

| | | | |
|---|---|---|---|
| 2,109,933 | 3/1938 | Sloan | 404/112 |
| 2,689,507 | 9/1954 | McCrery | 404/112 |
| 3,091,158 | 5/1963 | Bunger | 404/112 |
| 3,296,946 | 1/1967 | Cagno | 404/112 |
| 3,412,657 | 11/1968 | Colizza | 404/112 |
| 3,973,857 | 8/1976 | Whiteman | 404/112 |

*Primary Examiner*—Nile C. Byers
*Attorney, Agent, or Firm*—Joseph P. House, Jr.

[57] ABSTRACT

A concrete finisher of the type having driven paddles surrounded by a peripheral guard ring is made with one or more relieved guard ring sections, each preferably having a flattened outer edge, so that the finisher can be used to finish concrete surfaces adjacent to a wall or other obstruction. In some embodiments the relieved guard ring wall guide section is fixed. In other embodiments it is retractable.

12 Claims, 7 Drawing Figures

CONCRETE FINISHER WITH RETRACTABLE GUARD RING SECTION

SUMMARY OF THE INVENTION

This invention corrects a defect found in prior concrete finishers having rotating paddles surrounded by a peripheral guard ring intended to protect the operator and other persons and things from the moving paddles. Because of the projection of the guard ring outwardly beyond the tips of the rotating blades, prior such devices left an unfinished band or furrow next to walls and other obstructions which either remained unfinished or was left to be finished by hand. The present invention relieves a section of the guard ring so that the machine can finish a surface up to the surrounding walls without impairing the guarding function of the ring. An additional feature of this invention is to flatten the relieved segment of the guard ring so that the concrete finisher machine can be guided along an obstructing wall.

In some embodiments, the relieved segment is fixed. In other embodiments it is shiftable between an extended position in which it generally constitutes a continuation of the remaining portions of the guard ring and an inwardly retracted portion. In still other embodiments the retractable segment is retracted both inwardly and upwardly, thus to clear the underlying paddle as the segment is retracted.

Other objects, features and advantages of the invention will appear from the disclosure hereof.

DESCRIPTION OF THE PREFERRED EMBODIMENT

Figures 1, 2, 3, 4, 5, 6, 7:
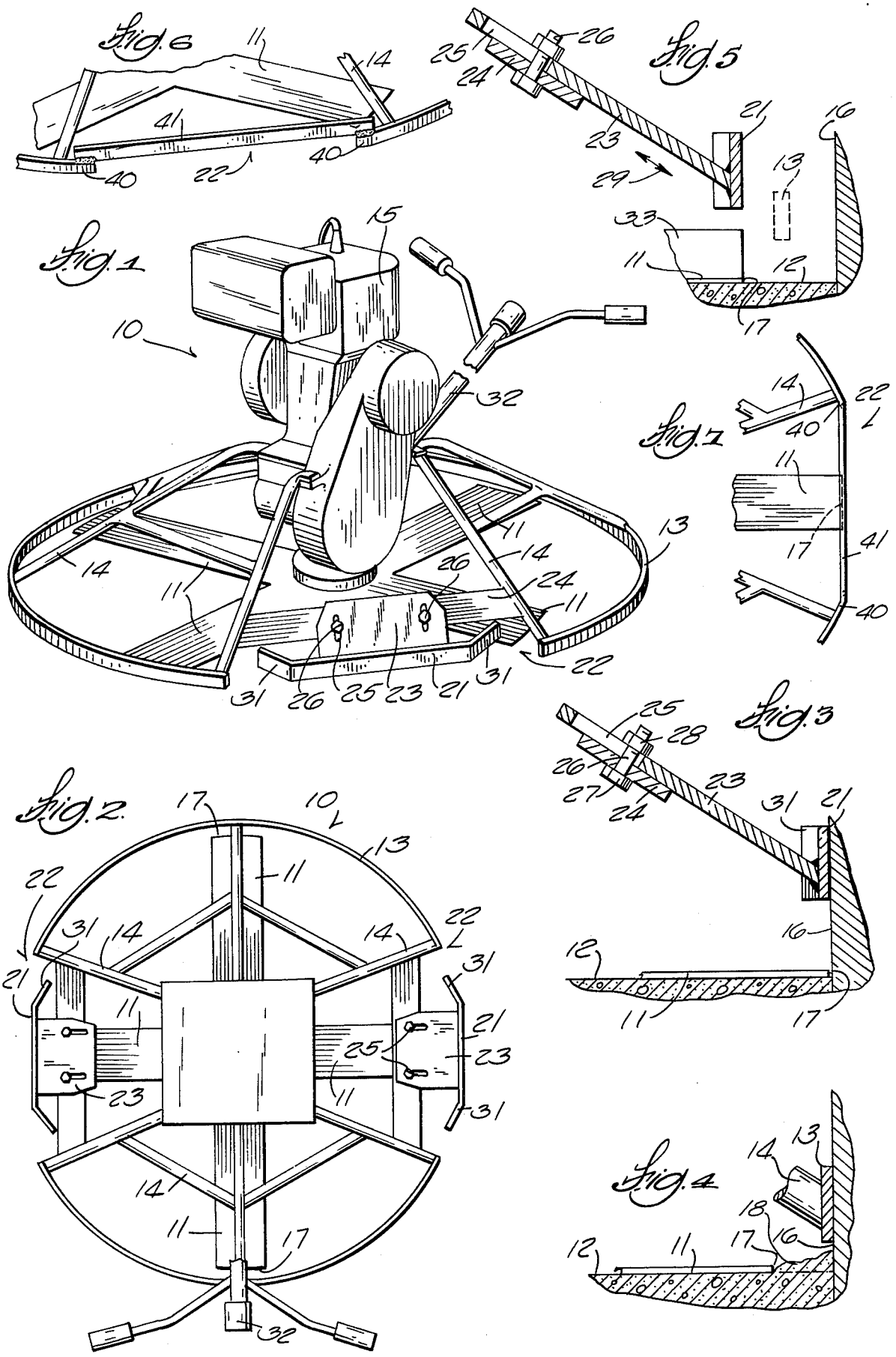
FIG. 1 is a perspective view of one embodiment of a concrete finisher incorporating the present invention.
FIG. 2 is a somewhat simplified top plan view of an embodiment of the invention in which the left- and right-hand retractable segments are provided.
FIG. 3 is a fragmentary cross section through a retractable guard ring segment and its retracting mechanism, showing the segment in abutting relation to a vertical wall and illustrating the segment in retracted position.
FIG. 4 is a view similar to FIG. 3, but illustrating the imperfect finishing which results when a concrete finisher with a non-relieved guard ring is used.
FIG. 5 is a fragmentary diagrammatic view showing the relation between the concrete floor, a wall, a conventional guard ring and a retractable guard ring section of the present invention.
FIG. 6 is a fragmentary perspective of a modified embodiment incorporating a fixed relieved guard ring segment.
FIG. 7 is a fragmentary plan view of the embodiment of FIG. 6.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

The concrete finishing machine 10 utilizes several rotary blades or paddles 11 to smooth or finish the upper surface of freshly poured concrete 12. Machine

10 is provided with a guard ring 13 which in conventional machines comprises a continuous ring encircling the path of rotation of blades 11. Ring 13 is spaced outwardly from the paddle tips 17 a distance of one or two inches. Ring 13 is typically supported on a spider frame comprising outwardly extending support bars 14. Paddles 11 support an engine 15 to which the inner ends of the spider frame bars 14 are attached.

A disadvantage in the use of the conventional machines, as thus far described, is illustrated in FIG. 4 of the drawing. Where the concrete 12 is to be finished adjacent a vertical obstruction, such as the wall 16, the guard ring 13 abuts the wall at a spacing of an inch or two from the blade tips 17. Accordingly, the concrete 12 between the blade tips 17 and the wall 16 is not subject to the smoothing action of the paddles 11 and a narrow furrow or band 18 of rough concrete is left adjacent the wall 16. If not removed, this furrow 18 will harden and remain adjacent the wall and will constitute an imperfection in the finished concrete. Furrow 18 can be removed or smoothed by hand, but this task involves laborious and expensive hand smoothing operations.

In accordance with the present invention, the guard ring 13 is provided with one or more relieved segments which are, or can be, offset inwardly of the guard ring circle, thus to permit the blades 11 to be brought into near proximity to a wall. In the embodiments of FIGS. 1–3 and 5, the ring 13 is provided with retractable guard ring segments 21 which are disposed in gaps 22 which interrupt the continuity of the ring 13. The segments 21 are mounted for radial movement on support blades or plates 23 which are slidably supported on bracket straps 24 which are desirably welded or otherwise fixed to the spider bars 14 and which span between adjacent bars 14, as shown in FIGS. 1 and 2. Bracket straps 24 also function to tie together spider frame portions otherwise separated by the gaps 22, as well as providing a base upon which the plates 23 are slidable.

In the preferred embodiments illustrated in FIGS. 1–3 and 5 of the drawings, plates 23 are provided with radially elongated slots 25. Bolts 26 extend through the slots 25 and have heads 27 bearing on the strap 24 and nuts bearing on the plates 23 and spanning across the slots 25. Accordingly, the segments 21 are easily shifted between the extreme positions illustrated at the left- and right-hand sides of FIG. 2. In this figure, the segment 21 at the left-hand side is shown in its fully retracted position and the segment at the right-hand side of this figure is shown in its fully extended position in which the segment 21 lies approximately on the arc or circle of ring 13. FIGS. 3 and 5 also illustrate the segment 21 in approximately its fully retracted position. In this position the tip 17 of paddle 11 can be brought into near proximity to the wall 16, thus to smooth the concrete 12 right up to the wall and without leaving a furrow or ridge such as furrow 18 of FIG. 4.

Segment 21 is desirably flat over its major portion. Segment ends 31 are angled inwardly. Thus the segment is shaped as a double-ended flat ski. This configuration facilitates use of the segment to bear on a flat wall 16 to guide movement of the machine 10 along the wall 16 as the operator pushes or pulls on the machine handle 32.

Bracket strap 24 is desirably inclined downwardly and outwardly. Accordingly, as bracket plate 23 of the ring segment 21 is retracted from its position shown at the right-hand side of FIG. 2 to its position shown at the left-hand side of FIG. 2, it will not only retract inwardly, but will also retract upwardly as illustrated by arrow 29 in FIG. 5. This is a desirable feature in instances where the paddle or blade 11 has any substantial vertical dimension, and particularly when it is provided with an edge flange such as flange 33 illustrated in FIG. 5. The elevation of segment 21 as it retracts to a position above the paddle 11 will clear the retracted segment 21 from any such flange 33 or any other elevated portion of the rotating paddle, and thus avoid interference therebetween.

In use, the operator will ordinarily dispose the segments 21 in their fully extended position, in which position they constitute an approximate continuation of the ring 13 and extend outwardly beyond the tips 17 of blades 11. However, when finishing the concrete along a vertical obstruction, the operator will stop the machine, loosen the nuts 28 on bolts 26 and retract the guard segment 21 which is adjacent the wall in order to position the parts as shown in FIGS. 3 and 5. The operator will then utilize the flat face of the segment 21 to guide the machine along the wall and to smooth the concrete up to the wall. After finishing the concrete along the wall, the operator will again stop the machine and will restore the retracted segment to its normal fully extended position.

The gap 22 and retractable segment 21 can be located at any desired point along the circumference of the guard ring 13. In the embodiment shown in FIG. 2, the segments 21 and gaps 22 are disposed at the opposite sides of the ring 13 and 90° arcuately disposed from the handle 32. This location of the segments 21 simplifies the task of the operator in propelling the machine along the wall. FIG. 1 illustrates a variation in this position in which the gap 22 and segment 21 is displaced 135° from the handle 32.

FIGS. 6 and 7 show a modified embodiment in which the guard ring 13 is provided with an inwardly relieved fixed segment 41. The guard ring 13 is cut off between adjacent spider legs 14 to leave stubs 40 and a flat bar or strap 41 welded across the gap 22. Strap 41 is desirably elevated above the level of the guard ring stubs 40. Accordingly, the strap 41 is above the level of the blades 11 and any flanges formed thereon. In this embodiment, the mid-point of strap 41 is disposed slightly outwardly of the tips 17 of the paddles 11.

In this manner the strap 41 is effective to function as a guard, but the machine may still be brought close enough to a wall so that the tips 17 of the blades 11 smooth concrete right up to the wall, but without contact therewith. The strap 41 is flat so that an operator can move the machine parallel to the wall with the flat strap 41 guiding said movement along the wall.

What is claimed is:

1. In a concrete surface finishing machine having driven finishing paddles surrounded outside their perimeter by a generally concentric guard ring, a gap in said ring, a retractable guard ring segment in said gap and retraction means mounted on said machine on which said segment is mounted for retraction of said segment inwardly to allow the driven finishing paddles to work up to an obstruction disposed at an edge of the concrete surface to be finished.

2. The invention of claim 1 in which said retraction means comprises means for retracting said segment upwardly as well as inwardly.

3. The invention of claim 1 in which the retractable segment has a flat portion on which the machine can be guided for movement along a flat obstruction.

4. The invention of claim 3 in which the segment has its ends bent inwardly at an angle to said flat portion.

5. The invention of claim 1 in which the finishing machine has a spider frame on which said guide ring is mounted, said spider frame comprising outwardly projecting bars, said retraction means comprising a bracket plate spanning between adjacent spider frame bars and a plate attached to the segment and slidable on said bracket plate.

6. The device of claim 5 in which said bracket plate is downwardly and outwardly inclined whereby the segment is retracted both vertically and upwardly.

7. The device of claim 1 in which the finishing machine has two such retractable segments disposed at opposite sides of the machine with respect to the direction in which it is propelled.

8. The device of claim 7 in which said segments have flat portions by which the machine can be guided along a flat wall.

9. In a concrete surface finishing machine having driven finishing paddles surrounded outside their perimeter by an attached generally concentric guard ring, a portion of said ring being inwardly relieved to permit the driven finishing paddles to work up to an obstruction disposed at an edge of the concrete surface to be finished.

10. The invention of claim 9 in which said inwardly relieved portion of said ring is disposed at a higher level than other portions of said ring.

11. The invention of claim 9 in which said inwardly relieved portion of said ring has a flat portion on which the machine can be guided for movement along a flat obstruction.

12. The invention of claim 9 in which said inwardly relieved portion of the ring comprises a retractable ring segment and means upon which said segment is mounted for retraction.

* * * * *